US005829875A

United States Patent [19]

Hagel et al.

[11] Patent Number: 5,829,875

[45] Date of Patent: Nov. 3, 1998

[54] COMBINED BARRIER AND MIXER ASSEMBLY FOR A CYLINDRICAL CONTAINER

[75] Inventors: Gerald W. Hagel, Lombard; Ronald N. Backman, Wayne, both of Ill.

[73] Assignee: Simpson Strong-Tie Co., Inc., Pleasanton, Calif.

[21] Appl. No.: 831,224

[22] Filed: Apr. 2, 1997

[51] Int. Cl.[6] ..... B01F 15/02; B67D 5/42

[52] U.S. Cl. ..... 366/333; 366/256; 366/189; 222/386

[58] Field of Search ..... 366/332, 333, 366/256, 255, 291, 242, 244, 245, 247, 189; 604/89, 91; 222/190, 136, 386, 256, 246, 546

[56] References Cited

U.S. PATENT DOCUMENTS

| | | | |
|---|---|---|---|
| 1,998,692 | 4/1935 | Van Rossem et al. | 366/333 |
| 2,166,437 | 7/1939 | Howie et al. | 366/256 |
| 3,140,078 | 7/1964 | Krahe et al. | 366/256 |
| 3,153,531 | 10/1964 | Cook | 366/191 |
| 3,164,303 | 1/1965 | Trautmann | 366/333 |
| 3,195,778 | 7/1965 | Coates | 222/136 |
| 3,475,010 | 10/1969 | Cook et al. | 366/333 |
| 4,197,967 | 4/1980 | Baur et al. | 366/256 |
| 4,371,094 | 2/1983 | Hutter, III | 366/333 |
| 4,469,153 | 9/1984 | Morrisette | 366/256 |

*Primary Examiner*—Tony G. Soohoo
*Attorney, Agent, or Firm*—James R. Cypher

[57] ABSTRACT

The present invention provides an apparatus for first separating and later mixing a of materials stored in a cylindrical container. The apparatus of the present invention serves as an effective barrier during storage of the materials. It also serves as an apparatus for thoroughly mixing the materials when they are ready to be used.

The apparatus of the present invention consists of: a mixing member formed with one or more mixing spokes for stirring the materials; a sealing member that releasably attaches to the mixing member and together with the mixing member forms a barrier when the two are joined, but separated from the mixing member allows for the combining of the materials within the container; and a mixing rod that attaches to the mixing member and is long enough to protrude from the container to allow the user to manipulate the mixing member. The apparatus of the present invention is formed so it is difficult for the mixing member and the sealing to reattach once they have separated.

35 Claims, 6 Drawing Sheets

COMBINED BARRIER AND MIXER ASSEMBLY FOR A CYLINDRICAL CONTAINER

BACKGROUND

This invention relates to containers in which a plurality of materials can be stored separately and then mixed just prior to being used. Specifically, this invention relates to an apparatus for use with a cylindrical container, the apparatus in a first selected state serving as a barrier to separate a plurality of materials stored in the cylindrical container, and in a second selected state serving as a mixer to combine and mix the materials.

There are many compounds of materials which, when mixed, become a strong bonding agent. Examples of these compounds include urethanes, polyester-based adhesives, epoxies, caulking compounds and grout. Many of these compounds are quick setting which means there is only a limited amount of time after the component materials have been mixed to apply them before they harden and can no longer serve as bonding agent. Thus, many of these compounds must be mixed and used in small quantities at a time. Furthermore, many of these compounds require that their separate component materials be combined in precise ratios in order to achieve the desired bonding and flow characteristics.

Because these materials, like the resin and hardener that form epoxy, may be costly, there has long been a demand for containers that hold separate precisely measured quantities of materials, and provide means for mixing and extruding them cleanly and quickly. A number of such containers have been produced, varying in form according to the nature and quantity of the stored materials, the qualities of the compound, the cost of manufacture, ease of assembly, ease of use, and the method of using them.

One approach adopted by the prior art provides a container with a barrier that at the time of use can be ruptured or distorted so that it no longer serves as a barrier. The barrier is ruptured or distorted by the action of a separate mixing member or dasher also located in the container which is attached to a rod that communicates to the outside. U.S. Pat. No. 3,153,531, granted Oct. 20, 1964 to Ralph. J. Cook uses a delicate foil barrier to create two compartments in a cylindrical container. When the materials are to be mixed the foil barrier is distorted allowing communication of the materials between the barrier. U.S Pat. No. 3,475,010, granted Oct. 28, 1969 to Ralph J. Cook and Clifford C. Moline, teaches using a foil barrier that is pierced by the mixing rod attached to the dasher or mixing member. The use of a delicate foil membrane as the barrier requires special provisions to avoid disrupting the barrier during the filling process. U.S. Pat. No. 3,195,778, granted Jul. 20, 1965 to J. Edwin Coates, teaches a more solid partition that is ruptured by severing means formed on the dasher or mixing member. Providing the dasher or mixing member with severing means sharp enough to rupture the more solid partition adds expense to its manufacture.

Another approach, more pertinent to the present invention, has been to provide the container with a multi-component assembly that can serve as a barrier or as a mixer depending upon the orientation and relative positions of its components. The prior art patents in this category also share the further characteristic, not possessed by the present invention, that the components can be joined together after mixing to serve as a piston or wiper.

The first patent of this type known to the inventor is U.S. Pat. No. 3,140,078, granted Jul. 7, 1964 to Donald C. Krahe.

It employs a pair of disks held together in close registration with corresponding openings so that the rotation of one disk exposes or occludes the corresponding openings in the other disk, thereby permitting or preventing the intermixing of the materials separated by the disks. Because the mere act of rotation of one disk with respect to the other either opens or closes the barrier between the two compartments, the user must be careful to avoid inadvertently opening or closing the barrier at the wrong time.

U.S. Pat. No. 3,164,303, granted Jan. 5, 1965 to Herbert L. Trautmann, is another such patent. Trautmann ('303) teaches forming a partition with a central bore that is releasably sealed by a dasher formed with a central boss. Similar to Krahe ('078), the user has to be careful about inadvertently reconnecting the dasher to the partition. Further, the partition is only provided with a single orifice that for the most part is blocked by the boss of the dasher when the partition is moved back to allow the combining of the materials. This slows the step of combining the materials.

The most recent patent of this type known to the inventor is U.S. Pat. No. 4,371,094, granted Feb. 1, 1983 to Charles G. Hutter III. Hutter III ('094), in a manner similar to Trautmann ('303), teaches a sealing member formed with a central sleeve orifice sealed by the central core of a dasher member. Hutter III ('094) attempts to address the problem of inadvertent reattachment of the dasher and the sealing member while also providing for the reattachment of the dasher member to the sealing member following the mixing operation. Hutter III ('094) accomplishes this but only by requiring that the operating rod be inserted into the dasher at various selected distances at different points in its use, requiring precise operations by the user. Further, the sealing member of Hutter III ('094), like Trautmann ('303), is also only formed with a single orifice that is mostly blocked by the central core of the dasher when the sealing member is moved to the end of the cylinder, slowing down the combining of the materials.

SUMMARY OF THE INVENTION

The present invention provides an apparatus for first separating and later mixing a plurality of materials stored in a cylindrical container. The apparatus of the present invention serves as an effective barrier during storage of the materials. It also serves as an apparatus for thoroughly mixing the materials when they are ready to be used. Further, the present invention accommodates simplified filling operations of the container. It is economical to produce, and it is simple to use.

The object of making an apparatus that serves as an effective barrier is achieved by forming a rigid mixing member and a rigid sealing member that when joined together prevent communication of the materials in the container through or around them.

The object of making an apparatus that serves to thoroughly mix the materials when they are ready to be used is achieved by forming the mixing member to receive a mixing rod that can be manipulated by the user, and by forming the mixing member to be separable from the sealing member to allow the combining of the materials.

The object of making an apparatus that thoroughly mixes the materials is further achieved by forming the mixing member, the sealing member and the mixing rod so that the mixing member and the sealing member are unlikely to reattach once they have been separated.

The object of making an apparatus that thoroughly mixes the materials when they are ready to be used is also achieved by forming the sealing member and the mixing member so that the sealing member can be provided with a plurality of openings for allowing the combining of the materials when the sealing member and mixing member are separated.

The object of making an apparatus that thoroughly mixes the materials is also achieved by forming the second end and the second end portion of the mixing rod for attachment to a rotary power tool for fast rotary mixing.

The object of making an apparatus that thoroughly mixes the material is achieved by forming the mixing rod and mixing member with stops that prevent the mixing member from traveling too far up the mixing rod.

The object of making an apparatus that thoroughly mixes the materials is achieved by forming the mixing member with ribs that help to displace the materials.

The object of making an apparatus that thoroughly mixes the materials is also achieved by forming the mixing member with a circular outer ring that facilitates rotary mixing by a power tool attached to the mixing rod.

The object of making an apparatus that accommodates simplified procedures for filling the container is achieved by forming the mixing rod to releasably attach to the mixing member so that the mixing rod need not be attached to the mixing member during the filling process.

The object of making an apparatus that accommodates simplified procedures for filling the container is further achieved by forming the rigid mixing and sealing members with cooperating shoulders that create a firm, releasable hold between the members so that they can be manipulated without destroying their function as a barrier.

The object of making an apparatus that accommodates simplified procedures for filling the container is further achieved by forming the mixing and sealing members with cooperating shoulders that create a firm, releasable hold between the members without the need to have the mixing rod attached to the mixing member.

The object of making an apparatus that accommodates simplified procedures for filling the container is further achieved by forming the mixing member and the sealing member so that they can be inserted into the cylindrical container during the filling process, allowing all filling of the container to occur through the wider outlet end of the container.

The object of making an apparatus that is economical to produce is achieved by forming the apparatus from a minimum number of parts.

The object of making an apparatus that is simple to use is achieved by forming the mixing member and the sealing member so that they can easily be separated by the user when the materials are ready to be used.

The object of making an apparatus that is simple to use is further achieved by forming the mixing rod and mixing member with stops that by bearing upon each other and preventing further entry of the mixing rod into the mixing member communicate to the user by feel that the mixing rod is sufficiently inserted into the mixing member to separate the mixing member and the sealing member.

The object of making an apparatus that is simple to use is further achieved by forming the mixing member with ribs that help to stabilize the mixing member for the insertion of the mixing rod into the rod attachment opening.

The object of making an apparatus that is simple to use is further achieved by forming protrusions on either the sealing member or the mixing member to prevent independent sliding rotation of the mixing member with respect to the sealing member.

The object of making an apparatus that is simple to use is further achieved by forming the mixing rod, the mixing member and the sealing member so the sealing member and the mixing member are unlikely to reattach once they have been separated.

BRIEF DESCRIPTION OF THE DRAWINGS

FIG. 17 is a cross-sectional view of the mixing rod taken along Line 17—17 of FIG. 4.

DESCRIPTION OF THE PREFERRED EMBODIMENT

The present invention is a multi-component apparatus 1 that is used in a cylindrical container 2 for separately storing a plurality of materials that are to be mixed in the container 2 just prior to use. The apparatus 1, as shown in FIG. 2, in a first selected state, serves as a barrier within the container 2 dividing it into a first compartment A and a second compartment B. As shown in FIG. 1A, in a second selected state, the apparatus 1 serves as a mixer for combining the materials within the cylindrical container 2.

Figure 1:
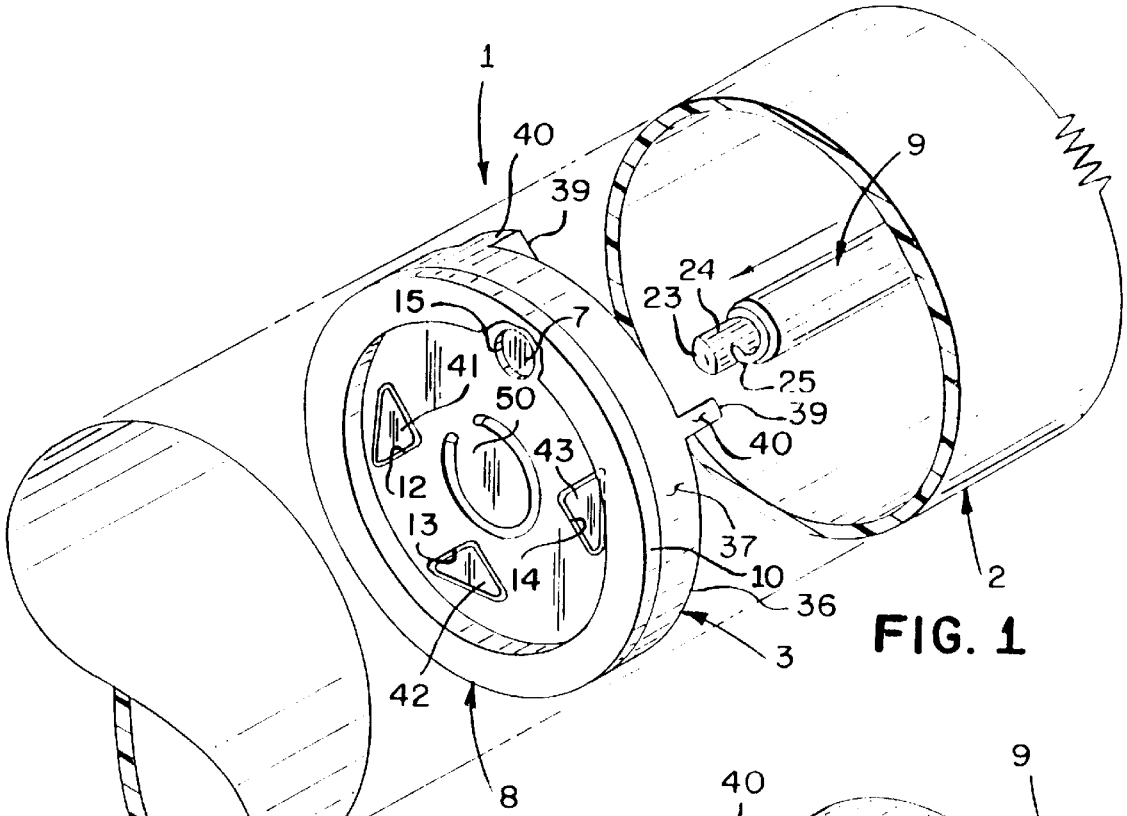
FIG. 1 is a perspective view of the apparatus in a first selected state shown inserted into a portion of a cylindrical container. The mixing member is joined to the sealing member. The mixing rod of the apparatus is shown inserted into the cylindrical container, but not yet attached to the mixing member. The cylindrical container is shown in section.
Figure 1A:
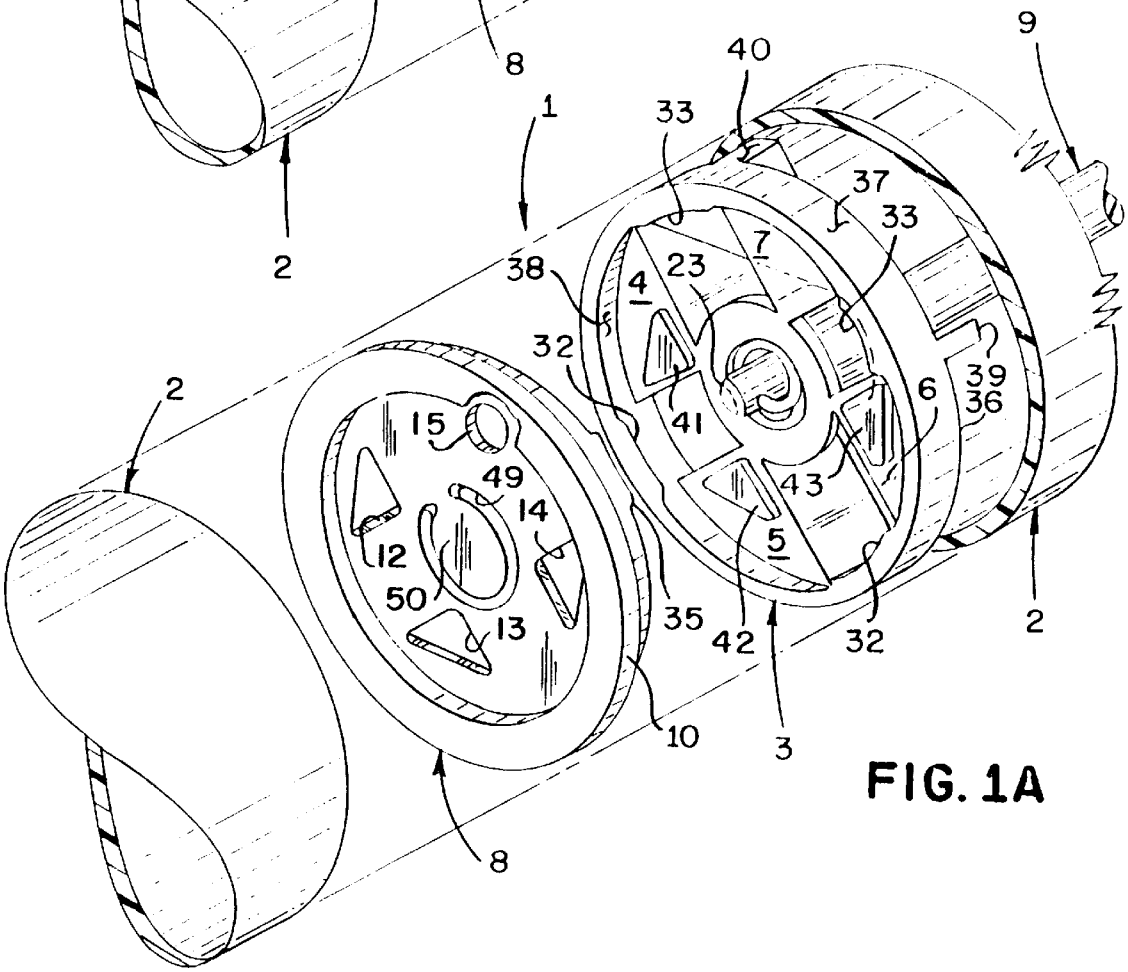
FIG. 1A is a perspective view of the apparatus in a second selected state shown inserted into a portion of a cylindrical container. The sealing member is detached from the mixing member, and the mixing rod of the apparatus is shown attached to the mixing member. The cylindrical container is shown in section.
Figure 2:
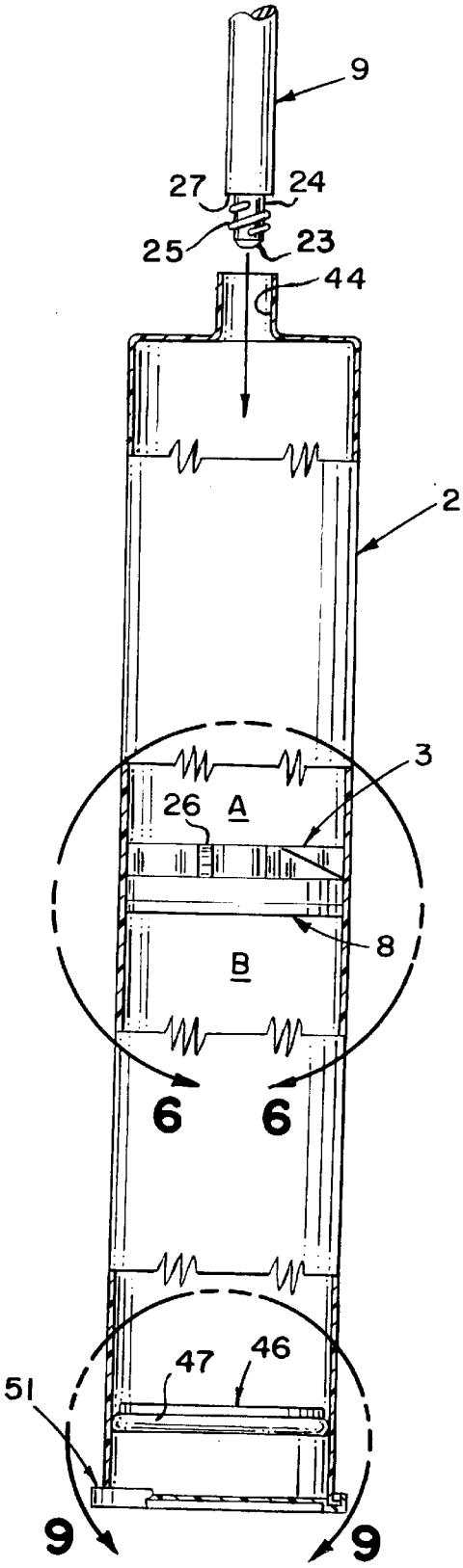
FIG. 2 is a side elevation view of the apparatus of the present invention. The sealing member is shown joined to the mixing member and inserted into a cylindrical container, dividing it into two compartments. A portion of the mixing rod of the apparatus is shown ready to be inserted into a cylindrical container through its dispensing outlet. Portions of the cylindrical container are shown in cross-section. The cylindrical container is shown with a wiper member inserted into the outlet end of the cylindrical container.

As is shown in FIGS. 1 and 1A, the apparatus 1 of the present invention consists of: a mixing member 3 formed with one or more mixing spokes 4, 5, 6 and 7 for stirring the materials; a sealing member 8 that releasably attaches to the mixing member 3 and together with the mixing member 3 forms a barrier when the two are joined, but separated from the mixing member 3 allows for the combining of the materials within the container 2; a mixing rod 9 that attaches to the mixing member 3 and is long enough to protrude from the container 2 to allow the user to manipulate the mixing member 3; and separation means to aid in preventing the reattachment of the mixing member 3 and the sealing member 8 once they have been separated.

Figure 8:
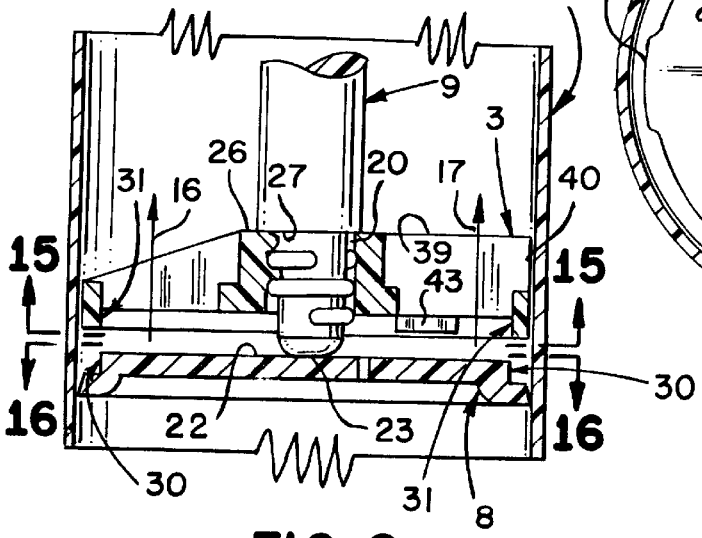
FIG. 8 is a side elevation view of the apparatus of the present invention taken along Line 8—8 of FIG. 4.

The mixing member 3 and the sealing member 8 can alternatively separate the materials or allow passage of the materials by virtue of their form. First, the sealing member 8 is formed as a circular disk with an outer edge 10 that extends radially to the inner surface 11 of the cylindrical container 2 forming a seal so that the materials cannot pass around the outer edge 10 of the sealing member 8. The sealing member 8 is also formed with one or more openings 12, 13, 14 and 15 that allow passage of the materials when the openings 1 2,13,14 and 15 are not covered. See FIG. 16. Mixing Spokes 4, 5, 6 and 7 formed in the mixing member 3 are dimensioned to cover the openings 1 2,13,14 and 15 in the sealing member 8 when the mixing member 3 and the sealing member 8 are joined and properly aligned. See FIG. 12. When the sealing member 8 and the mixing member 3 are separated the openings 12, 13, 14 and 15 in the sealing member 8 are uncovered and the materials can flow through the openings 12, 13, 14 and 15 in the sealing member 8 as is shown by arrows 16 and 17 in FIGS. 4, 5 and 8.

A number of alternate structures can serve as the separation means to aid in preventing the reattachment of the mixing member 3 and the sealing member 8 once they have become separated. The separation means keeps the mixing member 3 and the sealing member 8 sufficiently spaced apart so that they cannot reattach.

Figure 4:
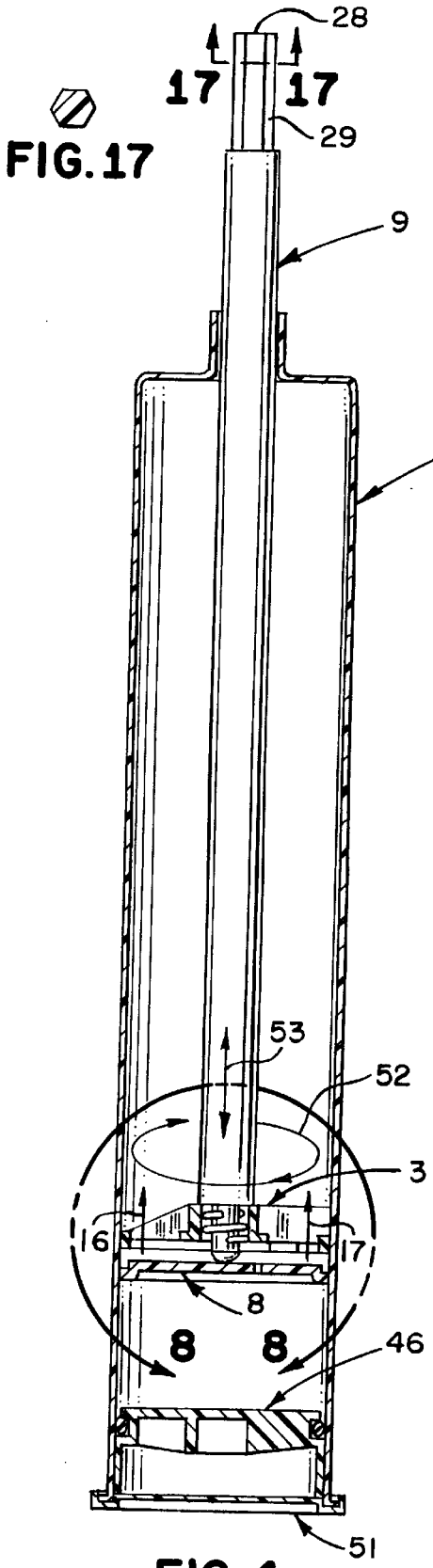
FIG. 4 is a side elevation view of the apparatus of the present invention as it would appear during the mixing of the materials. The sealing member is shown separated from the mixing member. The mixing rod is shown fully attached to the mixing member. The sealing member, mixing member, cylindrical container and wiper member are shown in cross-section.

As is shown in FIG. 4, in the preferred form of the invention, the mixing member 3 and the sealing member 8 are kept separate from each other during mixing by the interposition of a portion of the mixing rod 9 between them. This is accomplished by forming the mixing member 3, the sealing member 8 and the mixing rod 9 in the specific manner described below.

Figure 11:
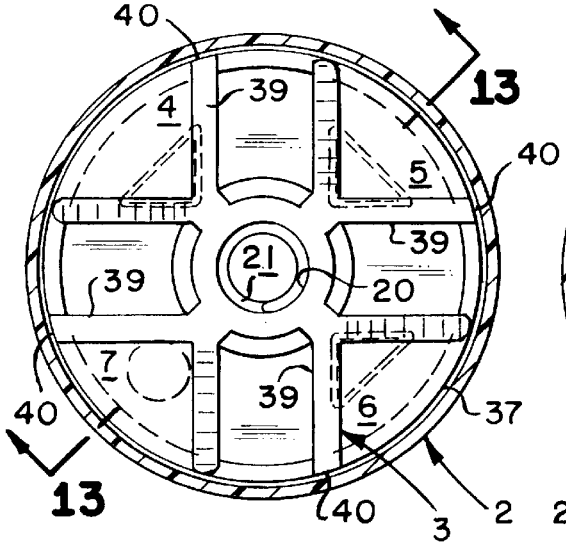
FIG. 11 is a top plan view of the joined mixing member and sealing member of the present invention taken along Line 11—11 of FIG. 6. The cylindrical container is shown in cross-section. Dashed lines show the protrusions that occur on the bottom side of the mixing member, the inner surface of the circular outer ring of the mixing member, and the openings in the sealing member.
Figure 7:
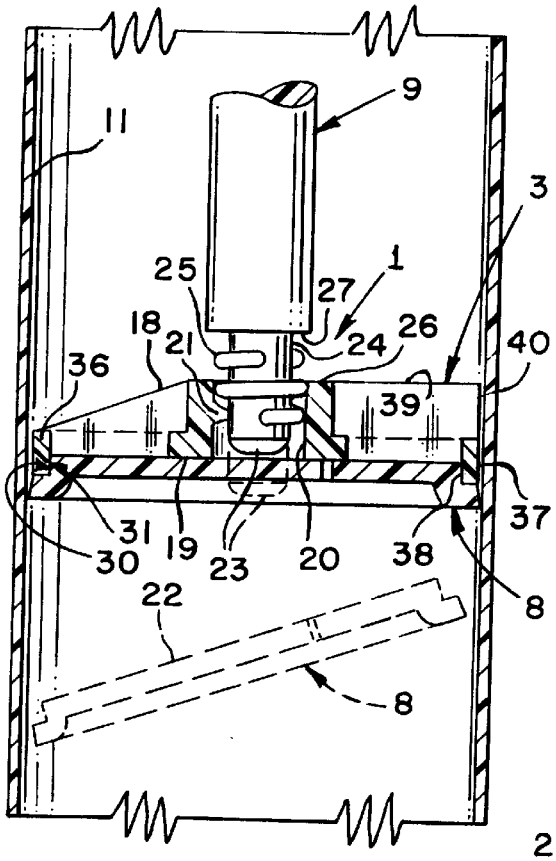
FIG. 7 is a side elevation view of the apparatus of the present invention taken along Line 7—7 of FIG. 3.

The mixing member 3 which has a top side 18 and a bottom side 19 is formed with a rod attachment opening 20 that can receive the mixing rod 9. See FIG. 7. The rod attachment opening 20 is formed with releasable attachment means 21 for attaching the mixing member 3 to the mixing rod 9. The sealing member 8 which releasably attaches to the bottom side 19 of the mixing member 3 is formed with a bearing surface 22 that overlays the rod attachment opening 20 of the mixing member 3. See FIGS. 11 and 12. As is shown in FIG. 7, it should be noted that the bearing surface 22 prevents passage of the materials through the rod attachment opening 20 when the sealing member 8 and the mixing member 3 are attached and properly aligned. Finally, the mixing rod 9 is formed with a first end 23 and a first end portion 24 that enter the rod attachment opening 20 at the top side 18 of the mixing member 3, the first end 23 of the mixing rod 9 passing through the rod attachment opening 20 and coming into contact with the bearing surface 22 of the sealing member 8, pushing the sealing member 8 away from the mixing member 3, when the first end portion 24 of the mixing rod 9 is fully received by the rod attachment opening 20 of the mixing member 3, as is shown in FIG. 7. The first end portion 24 of the mixing member 3 is specifically dimensioned in relation to the rod attachment opening 20 so that when the first end portion 24 of the mixing rod 9 is fully received by the rod attachment opening 20, the sealing member 8 is prevented from attaching to or remaining attached to the mixing member 3. See FIG. 8. The first end portion 24 is also formed with releasable attachment means 25 for releasably coupling with the releasable attachment means 21 of the rod attachment opening 20 in the mixing member 3.

Releasable attachment of the mixing member 3 and the mixing rod 9 allows the cylindrical container 2 to be filled, shipped and stored without the mixing rod 9 in place. Were the mixing rod 9 attached to the mixing member 3 during filling or storage inadvertent action on the mixing rod 9 could cause premature separation of the sealing member 8 from the mixing member 3. Further, the filling of the cylindrical container 2 with the component materials and the placement of the joined sealing member 8 and mixing member 3 is more easily accomplished with the mixing rod 9 detached from the mixing member 3. The design of the mixing rod 9 and the mixing member 3 make attachment of the mixing rod 9 by the user just prior to use a simple operation.

To assure that the sealing member 8 and the mixing member 3 separate at the desired time and to better maintain their separation, in the preferred embodiment of the invention, the mixing member 3 and the mixing rod 9 are formed with stops 26 and 27 that act in conjunction with the releasable attachment means 25 of the first end portion 24 of the mixing rod 9 and the releasable attachment means 21 of the rod attachment opening 20 formed in the mixing member 3. See FIG. 8. Proper use of the stops 26 and 27 assures that the mixing member 3 and the sealing member 8 separate and remain separated.

When the user attaches the mixing rod 9 to the mixing member 3, generally he will not be able to see whether the first end portion 24 of the mixing rod 9 has been fully received by the rod attachment opening 20 such that the mixing member 3 and the sealing member 8 have been forced to separate. The user may have only partially inserted the first end portion 24 of the mixing rod 9 into the mixing member 3. In the preferred embodiment, when the first end portion 24 of the mixing rod 9 has been sufficiently received by the rod attachment opening 20 to force the sealing member 8 away from the mixing member 3, the stops 26 and 27 formed in the mixing member 3 and the mixing rod 9 bear upon each other stopping further entry of the mixing rod 9 into the mixing member 3. By instructing the user to insert the mixing rod 9 into the mixing member 3 until the stop 27 of the mixing rod 9 bears upon the stop 26 of the mixing member 3, which the user will be able to feel, the initial separation and the continued separation of the mixing member 3 and the sealing member 8 is assured throughout the mixing process.

In the preferred embodiment, the stops 26 and 27 on the mixing member 3 and the mixing rod 9 also serve to keep the mixing member 3 near the first end 23 of the mixing rod 9. The mixing rod 9 is formed with a length that allows the first end 23 of the mixing rod 9 to entirely reach into the cylindrical container 2 while the second end 28 and second end portion 29 of the mixing rod 9 are available outside the cylindrical container 2 for actuation by the user. See FIG. 4. If the mixing member 3 could travel away from the first end 23 of the mixing rod 9, then even if the first end 23 could reach entirely into the cylindrical container 2 the user would not be assured that adequate mixing of the materials took place.

The releasable attachment of the sealing member 8 and the mixing member 3 can be achieved by forming the sealing member 8 and the mixing member 3 with corresponding male and female attachment portions 30 and 31. See FIG. 8. Either the sealing member 8 or the mixing member 3 can be formed with the female attachment portion 31. In the preferred form, the mixing member 3 is formed with a female attachment portion 31 that receives the male attachment portion 30 of the sealing member 8. Releasable attachment of the mixing member 3 and the sealing member 8 can be achieved by precisely forming the corresponding surfaces of the male and female attachment portions 30 and 31 for a tight friction fit.

Figure 15:
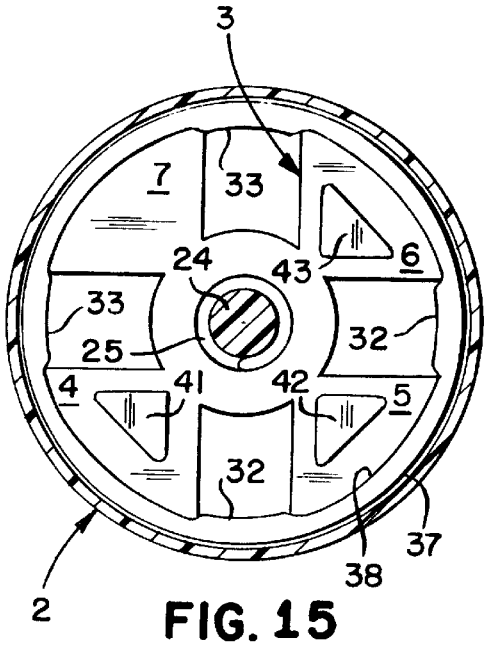
FIG. 15 is a bottom view of the mixing member and the mixing rod taken along Line 15—15 of FIG. 8. The cylindrical container is shown in cross-section.
Figure 16:
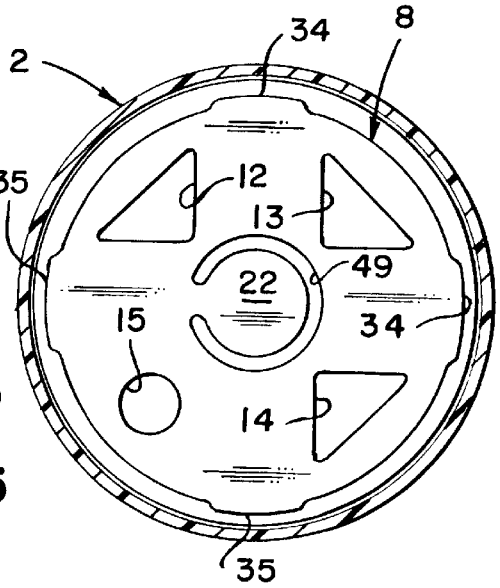
FIG. 16 is a top plan view of the sealing member of the present invention taken along Line 16—16 of FIG. 8. The cylindrical container is shown in cross-section.

In the preferred form, the male and female attachment portions 30 and 31 are releasably joined by mechanisms that provide a snap fit, shown in FIGS. 15 and 16. In the preferred form, the female attachment portion 31 of the mixing member 3 is formed with a first shoulder 32 and a second cooperating shoulder 33. The male attachment portion 30 of the sealing member 8 is formed with a first shoulder 34 which bears upon the first shoulder 32 of the mixing member 3 when the mixing member 3 and the sealing member 8 are in registration and properly aligned. The male attachment portion 30 of the sealing member 8 is also formed with a second cooperating shoulder 35 which bears upon the second cooperating shoulder 33 of the mixing member 3 when the mixing member 3 and the sealing member 8 are in registration and properly aligned. The first and second shoulders 34 and 35 of the sealing member 8 in conjunction with the first and second shoulders 32 and 33 of the mixing member 3 releasably hold the mixing member 3 to the sealing member 8.

Release of the first and second shoulders 32 and 33 of the mixing member 3 from the first and second shoulders 34 and 35 of the sealing member 8 is made possible by a combination of factors. The first and second shoulders 32 and 33 of the mixing member 3 and the first and second shoulders 34 and 35 of the sealing member 8 are formed to provide only the minimum bearing necessary to attach and hold the mixing member 3 and the sealing member 8 together given the forces that will act upon them during the filling and storing of the materials in the cylindrical container 2. Also, either one or both the mixing member 3 and the sealing member 8 can be formed out of material that allows for sufficient deformation to allow the first and second shoulders 34 and 35 of the sealing member 8 to slip past the first and second shoulders 32 and 33 of the mixing member 3 when a force designed to separate them is applied by the user. Nylon is one preferred material for forming the mixing member 3, the sealing member 8 and the mixing rod 9 which allows such deformation.

The releasable attachment means 21 formed in the rod attachment opening 20 of the mixing member 3 can be a slot for bayonet-type attachment of the first end portion 24 of the mixing rod 9. The releasable attachment means 25 formed in the first end portion 24 of the mixing rod 9 would then be a protrusion or plurality of protrusions formed for interlocking engagement with the slot in the rod attachment opening 20. In such an embodiment of the invention, the slot formed in the rod attachment opening 20 would also serve as the stop 26 formed in the mixing member 3. The protrusion formed in the first end portion 24 of the mixing rod 9 would serve as the stop 27 formed in the mixing rod 9.

In the preferred form of the invention, the releasable attachment means 21 formed in the rod attachment opening 20 of the mixing member 3 is a thread 21, and the releasable attachment means 25 formed in the mixing rod 9 is a corresponding thread 25 formed in the first end portion 24 of the mixing rod 9 that engages the thread 21 formed in the rod attachment opening 20 of the mixing member 3. See FIG. 7. Using a threaded connection provides a strong, stable attachment that continues as long as the mixing rod 9 is rotated one direction. When the user is ready to detach the mixing rod 9 from the mixing member 3, the cylindrical container 2 is pinched in the approximate location where the mixing member 3 is located to prevent its rotation, and the mixing rod 9 is rotated the opposite direction.

In the preferred embodiment, the thread 21 in the rod attachment opening 20 of the mixing member 3 stops short of traveling 360 degrees around the circumference of the rod attachment opening 20. This makes it easier to manufacture the mixing member 3 as a molded piece of plastic, because when certain plastics are used, such as nylon, the mixing member 3 can be lifted or snapped off the mold rather than unscrewed from the mold, saving time.

Further, in the preferred embodiment, the thread 21 formed in the rod attachment opening 20 of the mixing member 3 and thread 25 formed in the first end portion 24 of the mixing rod 9 are positioned so that the threads 21 and 25 engage each other before the first end 23 of the mixing rod 9 contacts the bearing surface 22 of the sealing member 8. See FIG. 7. This allows the mixing rod 9 to firmly attach to the mixing member 3 while the sealing member 8 and the mixing member 3 are still joined. When the sealing member 8 and the mixing member 3 are joined the sealing member 8 provides resistance against the rotating threading motion of the mixing rod 9 being attached to the mixing member 3.

It is to be noted that once the mixing rod 9 is attached to the mixing member 3, even if the first end portion 24 of the mixing rod 9 is not fully received by the rod attachment opening 20 of the mixing member 3 such that the sealing member 8 is forced away from the mixing member 3 by the pressing of the first end 23 of the mixing rod 9 on the bearing surface 22 of the sealing member 8, separation of the mixing member 3 and the sealing member 8 can be achieved by pulling the mixing member 3 away from the sealing member 8 by pulling on the mixing rod 9. This, however, is not the preferred method of separating the sealing member 8 from the mixing member 3. As was discussed above, the preferred method of operation calls for the user to attach the mixing rod 9 to the mixing member 3 so that the first end portion 24 of the mixing rod 9 is fully received by the rod attachment opening 20 and the sealing member 8 is forced off the mixing member 3 by the first end 23 of the mixing rod 9. The stops 26 and 27 formed in the mixing member 3 and the mixing rod 9 aid in achieving this result. Separating the sealing member 8 and the mixing member 3 in the preferred manner assures that the first end 23 and a segment of the first end portion 24 of the mixing rod 9 will remain interposed between the sealing member 8 and the mixing member 3 preventing their reattachment.

As is shown in FIG. 1A, in the preferred embodiment of the invention, the mixing member 3 is formed with a plurality of mixing spokes 4, 5, 6 and 7 joined by a circular outer ring 36. The circular outer ring 36 is preferably dimensioned so that the mixing member 3 can be disposed within the cylindrical container 2 with the outer surface 37 of the cylindrical outer ring disposed near the inner surface 11 of the cylindrical container 2 without touching it. The circular outer ring 36 facilitates rotation of the mixing member 3 to provide complete mixing without generating too much heat from contact between the mixing member 3 and the cylindrical container 2.

As is shown in FIGS. 7 and 15, in the preferred embodiment of the invention, the circular outer ring 36 protrudes from the bottom side 19 of the mixing member 3 to form the female attachment portion 31 to receive the male attachment portion 30 of the sealing member 8. The circular outer ring 36 is formed with an inner surface 38 disposed toward the center of the circular outer ring 36. The first and second shoulders 32 and 33 of the female attachment portion 31 are formed on the inner surface 38 of the circular outer ring 36 opposed from each other to clampingly engage the first and second shoulders 34 and 35 formed in the male attachment portion 30 of the sealing member 8.

As is shown in FIG. 15, in the preferred embodiment, a second pair of first and second shoulders 32 and 33 are formed on the inner surface 38 of the circular outer ring 36 opposed from each other. A corresponding second pair of first and second shoulders 34 and 35 are formed in the male attachment portion 30 of the sealing member 8. See FIG. 16.

It is to be noted that instead of forming the inner surface 38 of the circular outer ring 36 with discrete pairs of first and second shoulders 32 and 33, the first and second shoulders 32 and 33 could extend around the inner surface 38 of the circular outer ring 36 to join and form a single continuos protrusion or shoulder.

Figure 6:
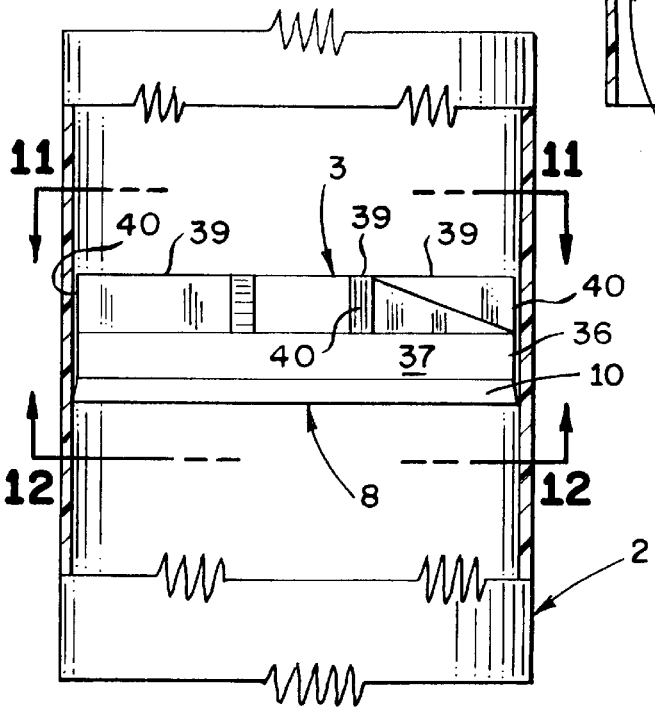
FIG. 6 is a side elevation view of the apparatus of the present invention taken along Line 6—6 of FIG. 2. A portion of the cylindrical container is shown in cross-section.

In the preferred form of the invention, the mixing member 3 is formed with a plurality of ribs 39. See FIG. 1A. Each of these ribs 39 has a lateral edge 40 that is disposed in close proximity to the inner surface 11 of the cylindrical container 2 when the mixing member 3 is attached to the sealing member 8 and placed in the cylindrical container 2 so as to form a barrier. See FIG. 6. The lateral edges 40 of the ribs 39 help to stabilize and maintain the orientation of the mixing member 3 and the sealing member 8 when they are joined with respect to the inner surface 11 of the cylindrical container 2 to facilitate insertion of the mixing rod 9 into the rod attachment opening 20.

As is shown in FIGS. 4 and 17, in the preferred form of the invention, the mixing rod 9 is specifically formed with a second end portion 29 and a second end 28 adapted for attachment to a rotary power tool, such as a power drill. In the preferred form, the second end portion 29 and the second end 28 are formed as a hexagonal head for attachment to a female hexagonal bit that can attach to any standard power drill. Mixing by means of a rotary power tool assures the user that the materials will be adequately mixed.

In the preferred form of the invention, the sealing member 8 and the mixing member 3 are formed so that independent sliding rotation between the sealing member 8 and the mixing member 3 is prevented. By preventing rotation of the sealing member 8 with respect to the mixing member 3 when they are joined, attachment of the mixing rod 9 to the mixing member 3 is facilitated. To attach the mixing rod 9 to the mixing member 3 the mixing rod 9 must be rotated with respect to the mixing member 3 to interlock with it. When the sealing member 8 holds the mixing member 3, preventing rotation of the mixing member 3, attachment of the mixing rod 9 to the mixing member 3 is facilitated.

Preventing rotation of the sealing member 8 with respect to the mixing member 3 also facilitates the operations of loading the joined sealing member 8 and mixing member 3 into the cylindrical container 2 and filling the container 2. There is less worry that the mixing spokes 4, 5, 6 and 7 will be rotated out of alignment with the openings 12, 13, 14 and 15 in the sealing member 8, uncovering them.

In one form of the invention, the sealing member 8 is formed with one or more protrusions that prevent sliding rotation of the mixing member 3 with respect to the sealing member 8 by abutting one or more mixing spokes 12, 13, 14 and 15.

Forming the sealing member 8 with one or more protrusions that prevent rotation of the sealing member 8 with respect to the mixing member 3 when they are joined also can serve to help prevent the reattachment of the sealing member 8 and the mixing member 3 once they have been separated. The protrusions in the sealing member 8 can be formed so that if the mixing spokes 4, 5, 6 and 7 are not aligned with the openings 12, 13, 14 and 15 in the sealing member 8, the protrusions press against the bottom side 19 of the mixing member 3 and the mixing spokes 4, 5, 6 and 7, preventing the attachment of the sealing member 8 and the mixing member 3. Furthermore, the mixing spokes 4, 5, 6 and 7, the openings 12, 13, 14 and 15 in the sealing member 8 and the protrusions on the sealing member 8 can be formed so that sealing member 8 and the mixing member 3 can attach or reattach only when they are in a specific selected radial alignment, thus they can serve as a means to aid in preventing the reattachment of the sealing member 8 and the mixing member 3.

Requiring a specific radial orientation of the mixing member 3 and the sealing member 8 for attachment can be accomplished by forming the pairs of mixing spokes 4, 5, 6 and 7 and openings 12, 13, 14 and 15 they cover, and the protrusions in which the mixing spokes 4, 5, 6 and 7 fit with unique dimensions individual to each pair. This can also be accomplished by forming a plurality of mixing spokes 4, 5, 6 and 7, openings 12, 13, 14 and 15 in the sealing member 8, and protrusions in the sealing member 8 at various radial positions with arcs of varing dimensions between them that require a specific selected alignment. Consider a mixing member 3 having just two mixing spokes 4 and 5 and a sealing member 8 having two openings 12 and 13 covered by them. The mixing spokes 4 and 5 could only cover the openings 12 and 13 in the sealing member 8 at a single selected radial orientation of the mixing member 3 to the sealing member 8, if the arc between the two openings 12 and 13 was less than 180 degrees. By forming protrusions on the sealing member 8 that prevent the reattachment of the mixing member 3 and the sealing member 8 when the mixing member 3 and the sealing member 8 are not aligned in a single specific radial orientation, the sealing member 8 and the mixing member 3 will in all likelihood remain separated during the mixing operation. This is especially true in light of the fact that in the preferred form of the invention, the mixing member 3 is being rotated by a rotary power tool.

Figure 12:
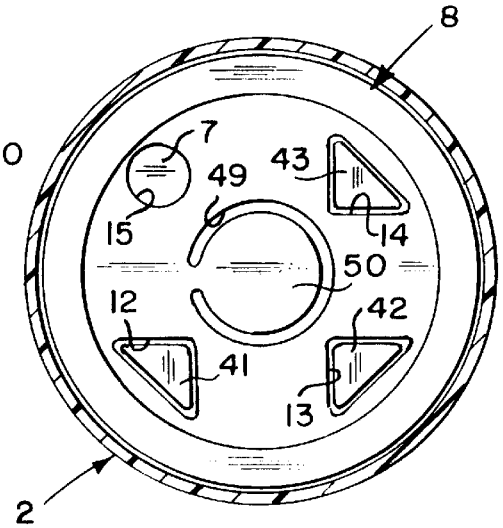
FIG. 12 is a bottom view of the joined sealing member and mixing member of the present invention taken along Line 12—12 of FIG. 6. The cylindrical container is shown in cross-section.

As is shown in FIGS. 1A and 12, one or more protrusions 41, 42 and 43 can also be formed on one or more of the mixing spokes 4, 5 and 6 of the mixing member 3. These protrusions enter the openings 12, 13 and 14 in the sealing member 8, when the mixing member 3 and the sealing member 8 are joined. The protrusions 41, 42 and 43 on the mixing spokes 4, 5 and 6 prevent independent sliding rotation of the mixing member 3 with respect to the sealing member 8. Further, the protrusions 41, 42 and 43 act to keep the mixing member 3 and the sealing member 8 apart once they are separated. By forming the protrusions 41, 42 and 43 on the mixing spokes 4, 5 and 6 and the openings 12, 13, 14 and 15 in a particular manner, they can prevent the sealing member 8 and the mixing member 3 from attaching to each other, except when they are a specific radial orientation, and thus serve as means to aid in preventing the reattachment of the sealing member 8 to the mixing member 3 once they become separated.

If the mixing member 3 was formed with only one mixing spoke 4 and the sealing member 8 was formed with only one opening 12, then a protrusion 41 formed on the mixing spoke that entered the opening 12 in the sealing member 8 when the mixing member 3 and sealing member 8 were joined would by its nature require that the sealing member 8 and the mixing member 3 could only attach or reattach when they were in a specific selected radial alignment.

As was mentioned above, in the preferred form, the sealing member 8 is formed with a plurality of openings 12, 13, 14 and 15 to facilitate the intermixing of the materials once the mixing member 3 is separated from the sealing member 8. This requires that the mixing member 3 be formed with a corresponding number of mixing spokes 4, 5, 6 and 7.

In order to best prevent reattachment of the sealing member 8 and the mixing member 3, the mixing spokes 4, 5, 6 and 7, the openings 12, 13, 14 and 15 in the sealing member 8 and the protrusions 41, 42 and 43 on the sealing member 8 can be formed so that sealing member 8 and the mixing member 3 can attach or reattach only when the mixing member 3 and the sealing member 8 are in a specific selected radial alignment. One way that this can be accomplished is by forming the mixing spokes 4, 5, 6 and 7 and the openings 12, 13, 14 and 15 they cover at irregular radial positions, or unequal radial arcs around the mixing member 3 and the sealing member 8.

Another way to accomplish this is to form one or more of the openings 12, 13, 14 and 15 at a distance from the center of the sealing member 8 that is unique to it. This irregularity in the positioning of one or more of the openings 12, 13, 14 and 15 coupled with the fact that the protrusions 41, 42 and 43 formed on the mixing member 3 each must enter an opening 12, 13, 14 or 15 in the sealing member 8 in order for the mixing member 3 and the sealing member 8 to join, requires that the sealing member 8 and the mixing member 3 can only attach when they are in a single, specific radial alignment.

In the preferred form, the mixing member 3 and the sealing member 8 are limited to attaching to each other when they are in a single specific radial orientation by forming protrusions 41, 42 and 43 on only a selected number of mixing spokes 4, 5 and 6, and shaping the protrusions 41, 42 and 43 so that they can only enter selected openings 12, 13 and 14 in the sealing member 8. Specifically in the preferred form, four openings 12, 13, 14 and 15, spaced at equal distances around the circumference of the sealing member 8, are formed in the sealing member 8, three of which are triangular openings 12, 13 and 14 and one of which is a circular opening 15. On the mixing member 3, three triangular protrusions 41, 42 and 43 are formed on three mixing spokes 4, 5 and 6 to correspond to the three triangular openings 12, 13 and 14 in the sealing member 8. The triangular protrusions 41, 42 and 43 on the mixing spokes 4, 5 and 6 cannot fit into the circular opening 15 in the sealing member 8, thus the sealing member 8 and the mixing member 3 can only attach when the three triangular protrusions 41, 42 and 43 align with the three triangular openings 12, 13 and 14 in the sealing member 8.

As was mentioned above, a number of alternate structures can serve as the means to aid in preventing the reattachment of the mixing member 3 and the sealing member 8 once they have become separated, by keeping them sufficiently spaced apart. The preferred embodiment is a combination of means to aid in preventing the reattachment of the sealing member 8 to the mixing member 3. In the preferred form of the invention, the mixing member 3, the sealing member 8 and mixing rod 9 are formed so that the sealing member 8 and the mixing member 3 are kept separate from each other by the interposition of a portion of the mixing rod 9 between them. Also in the preferred form of the invention, triangular protrusions 41, 42 and 43 are formed on selected mixing spokes 4, 5 and 6 that can enter only selected openings 12, 13 and 14 in the sealing member 8, such that the triangular protrusions 41, 42 and 43 keep the mixing member 3 separated from the sealing member 8 unless the sealing member 8 and the mixing member 3 are in a specific selected radial alignment.

The invention in its preferred form is used in the following manner. This description of the use of the invention applies to a container 2 filled with two separate materials such as a resin and a hardener that will form an epoxy bonding agent when mixed. FIG. 2, shows the sealing member 8 and the mixing member 3 in the first selected state wherein they are joined and serve as a barrier. FIG. 2 shows the joined sealing member 8 and the mixing member 3 placed midway in the cylindrical container 2. The joined sealing member 8 and mixing member 3 can be placed anywhere in the cylindrical container 2 to create the desired compartment sizes.

Generally, the cylindrical container 2 is formed with a narrow dispensing outlet 44 at one end and an end outlet 45 as wide as the cylindrical container 2 at the other end. See FIG. 5. The narrow dispensing outlet 44 can be formed to receive a nozzle attachment to aid in the proper placement of the combined materials when they are extruded from the container 2. The end outlet 45 is formed to receive a wiper member 46 that closes off the cylindrical container 2 once it has been filled.

Figure 5:
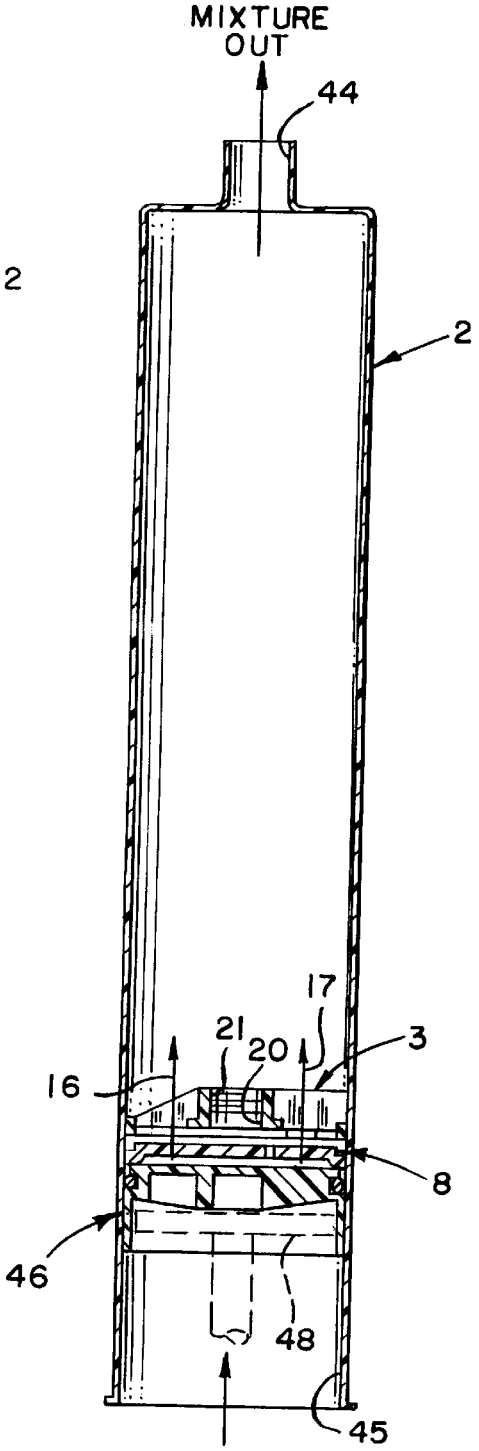
FIG. 5 is a side elevation view of the mixing member and sealing member of the present invention shown as they might appear after mixing has been completed. The sealing member is shown separated from the mixing member. The ram head of a ratchet gun is shown pushing the wiper member, and with it the sealing member and the mixing member towards the dispensing outlet to extrude the material from the container.
Figure 9:
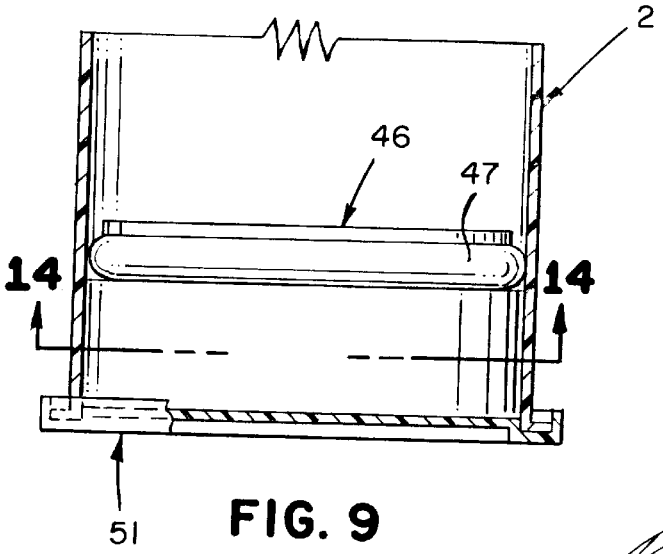
FIG. 9 is a side elevation view of the wiper taken along Line 9—9 of FIG. 2. The cylindrical container is shown in cross-section.
Figure 14:
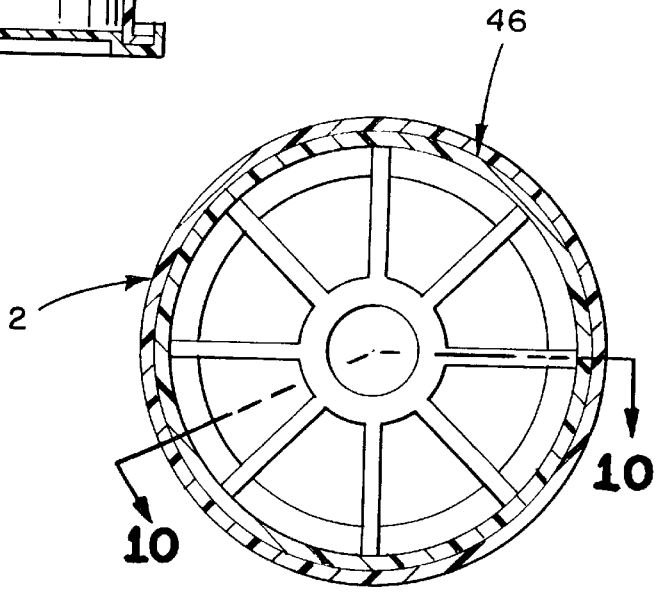
FIG. 14 is a cross-sectional view of a wiper member taken along Line 14—14 of FIG. 9.

As is shown in FIG. 9, the wiper member 46 should be formed with an o-ring 47. The o-ring 47 provides a friction fit between the wiper member 46 and the inner surface 11 of the cylindrical container 2 that is strong enough to prevent the wiper member 46 from being forced out of the container 2 during the reciprocation of the mixing rod 9 back and forth in the cylindrical container 2 during the mixing operation. The o-ring 47 is loose enough to allow the ram head 48 of a ratchet gun to push the wiper member 46 to extrude the mixed material. As is shown in FIG. 5, the wiper member 46 is designed to receive the ram head 48 of a ratchet or caulking gun or other device for exerting a pushing force on the wiper member 46. Once the materials have been thoroughly mixed the cylindrical container 2 is loaded into a ratchet gun, and the ram head 48 is used to push the wiper member 46 into the cylindrical container 2, forcing the mixed materials out the un-capped dispensing outlet 44.

The joined sealing member 8 and mixing member 3 of the present invention can be inserted into the cylindrical container 2 during the filling process. This allows the cylindrical container 2 to travel on the production line with the dispensing outlet 44 pointing down and capped, and for all filling operations to take place at the wider end outlet 45.

The first material is injected into the cylindrical container 2 through the end outlet 45. Because the end outlet 45 is wide, the material can be quickly injected into the cylindrical container 2.

The joined sealing member 8 and mixing member 3 are then inserted into the cylindrical container 2 until they meet the first material. The mixing member 3 is disposed toward the dispensing outlet 44, as is shown in FIG. 2.

Prior to insertion of the joined sealing member 8 and mixing member 3 into the cylindrical container 2, a wire can be inserted along the inner surface 11 of the cylindrical container 2. When the joined sealing member 8 and the mixing member 3 are inserted into the cylindrical container 2 the wire is disposed between the outer edge 10 of the sealing member 8 and the inner surface 11 of the cylindrical container 2. The wire creates an outlet through which the air trapped in the decreasing space between the first material and the joined sealing member 8 and mixing member 3 can escape. Once the joined sealing member 8 and mixing member 3 are fully inserted the wire can be retracted from the cylindrical container 2.

Figure 13:
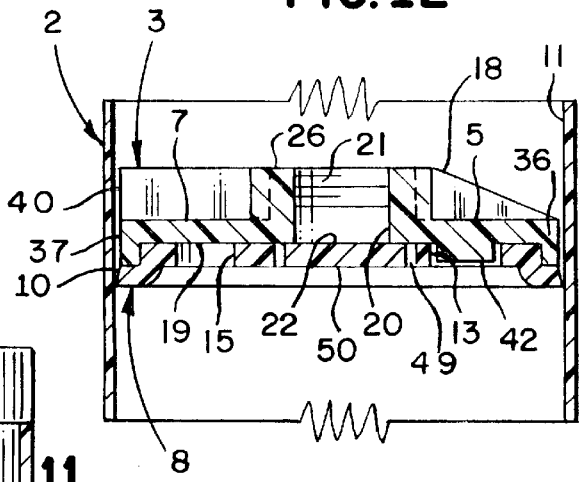
FIG. 13 is a cross-sectional view of the mixing member and the sealing member of the present invention taken along line 13—13 of FIG. 11. The sealing member is shown joined to the mixing member.

Alternatively, and in the preferred form of the invention, the sealing member 8 is formed with a vent 49 for bleeding the air trapped between the first material and the joined sealing member 8 and mixing member 3. This vent 49 is best shown in FIGS. 12 and 13. In the preferred embodiment, it is formed as a c-shaped opening, creating a lid 50 for the vent 49. Normally, when the sealing member 8 and the mixing member 3 are joined this vent 49 is closed. The lid 50 of the vent 49 and the mixing member 3 combine to seal the vent 49. However, when the joined sealing member 8 and mixing member 3 are pushed down into the cylindrical container 2 air pressure builds sufficiently to push the lid 50 open to allow the trapped air to escape out the vent 49.

It is to be noted that the vent 49 could also be formed as a plurality of small holes in the sealing member 8 that would allow the passage of air but would be too small to allow the passage of the materials to be stored in the cylindrical container 2.

Once the joined sealing member 8 and mixing member 3 have been placed in the cylindrical container 2, the second material is injected through the end outlet 45 into the container 2. The wiper member 46 is then inserted into the cylindrical container 2 to seal it. Prior to the insertion of the wiper member 46, a wire can be inserted along the inner surface 11 of the cylindrical container 2. When the wiper member 46 is inserted into the cylindrical container 2 the wire is disposed between the wiper member 46 and the inner surface 11 of the cylindrical container 2, forming an outlet through which the air trapped in the decreasing space between the second material and the wiper member 46 can escape. The wire is then retracted from they cylindrical container 2.

Figure 10:
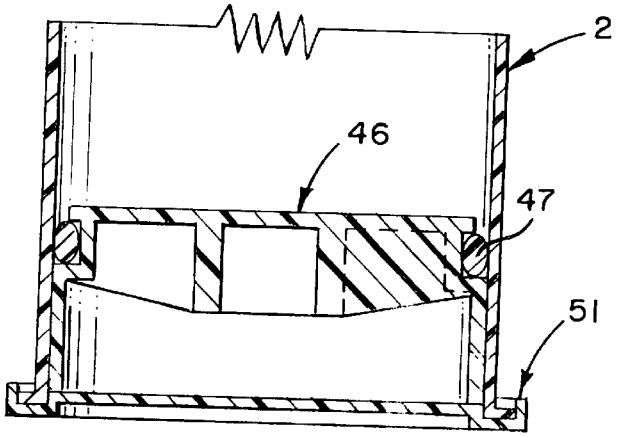
FIG. 10 is a cross-sectional side view of the wiper taken along Line 10—10 of FIG. 3. The cylindrical container is shown in cross-section.

As is shown in FIGS. 9 and 10, a cap 51 can be placed on the container 2, covering the end outlet 45, to further hold the wiper member 46 in the cylindrical container 2 during the mixing operation.

Once filled, the materials can be stored in the cylindrical container 2 for a prolonged period of time. The cylindrical container 2 can be shipped to the user packaged together with a mixing rod 9.

Figure 3:
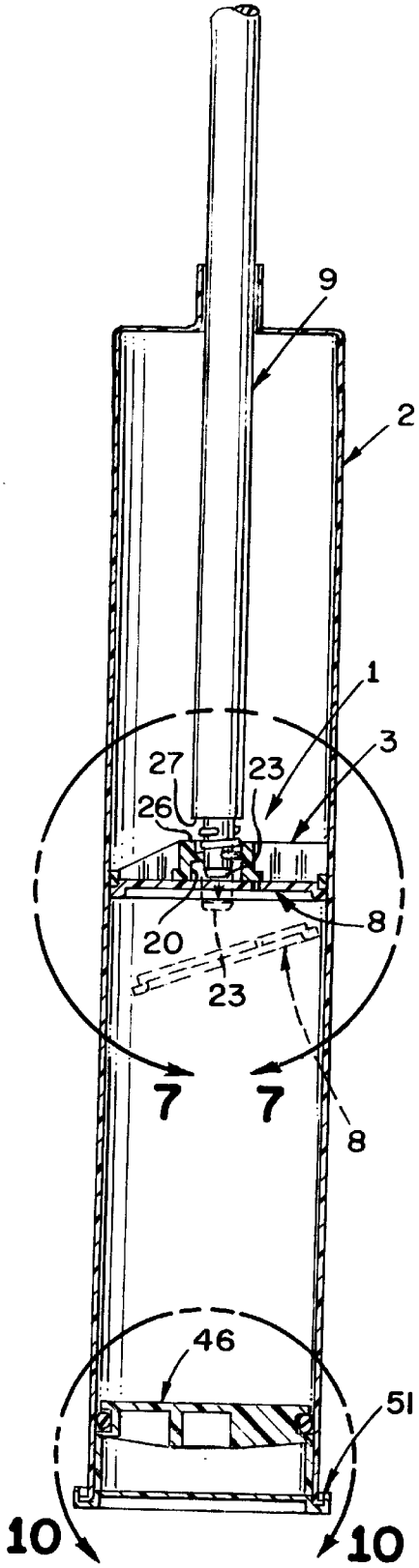
FIG. 3 is a side elevation view of the apparatus of the present invention. The sealing member is shown joined to the mixing member. The sealing member is also shown separated from the mixing member in phantom by dashed lines. The sealing member and the mixing member are shown in cross-section. The first end portion of the mixing rod is also shown in phantom by dashed lines to represent the location of the first end of the mixing rod when the mixing rod is fully inserted into the mixing member. The cylindrical container and the wiper member are shown in cross-section.

In the preferred method of operation, when the user is ready to combine and use the materials, the user unseals the dispensing outlet 44. The user then inserts the mixing rod 9 into the cylindrical container 2 through the dispensing outlet 44, as is shown in FIGS. 1 and 2. The mixing rod 9 is threadably attached to the mixing member 3 and screwed in until the stops 26 and 27 on the mixing member 3 and the mixing rod 9 prevent further entry of the first end portion 24 of the mixing rod 9 into the mixing member 3. See FIG. 4 By nature of its design, the full insertion of the first end portion 24 into the rod attachment opening 20 of the sealing member 8 forces the sealing member 8 to separate from the mixing member 3. See FIG. 3. The user then pushes the mixing rod 9 into the cylindrical container 2 as far as it will go, pushing the sealing member 8 close to the wiper member 46. The user then attaches the second end 28 and second end portion 29 of the mixing rod 9 to a rotary power tool. The rotary power tool is actuated to provide rotary mixing of the materials as is shown by arrow 52. The user also reciprocates the mixing rod 9 back and forth in the cylindrical container 2 to better mix the materials, as is shown by arrow 53.

When the user has mixed the materials sufficiently, the rotary power tool is detached from the mixing rod 9. The user then grasps the outside of the cylindrical container 2 in the approximate location where the mixing member 3 is located and unthreads the mixing rod 9 from the mixing member 3. The mixing rod 9 is extracted from the cylindrical container 2, and the cylindrical container 2 is loaded into a ratchet or caulking gun with the ram head 48 of the ratchet gun pressing against the wiper member 46. A dispensing nozzle can be attached to the dispensing outlet 44. The ratchet gun is then actuated to extrude the materials in the desired location. As the wiper member 46 travels through the cylindrical container 2 it pushes the separated sealing member 8 and mixing member 3 with it, as is shown in FIG. 5.

The invention is not limited to the specific form shown, but includes all forms within the definition of the following claims.

We claim:

1. A container for separately storing a plurality of materials, subsequently mixing them and later dispensing the mixture of said materials, said container comprising:

a) a cylindrical container having,
i) a dispensing outlet,
ii) an end outlet, and
iii) an inner surface;

b) a wiper member, said wiper member being inserted into said cylindrical container, said wiper member being formed to interface with said inner surface of said cylindrical container to close off said end outlet;

c) a mixing member, said mixing member being disposed in said cylindrical container at an intermediate position between said dispensing outlet and said end outlet, said mixing member having a mixing spoke;

d) a sealing member, said sealing member being circular in shape, said sealing member having,
i) an opening of a dimension that can be covered by said mixing spoke, and
ii) an outer edge that can extend radially to said inner surface of said cylindrical container, when said sealing member is substantially perpendicular to said inner surface of said cylindrical container, said sealing member being releasably attached to said mixing member, and said mixing member and said sealing member being aligned and disposed in said cylindrical container such that said opening in said sealing member is covered by said mixing spoke and said outer edge of said sealing member is substantially perpendicular to said inner surface of said cylindrical container, such that said outer edge forms a seal with said inner surface of said cylindrical container whereby said materials cannot substantially pass around said sealing member nor can said materials substantially pass through said opening in said sealing member such that said sealing member and said mixing member create a barrier;

e) a mixing rod attached to said mixing member, said mixing rod protruding from said cylindrical container, allowing for rotation and manipulation of said mixing member; and f) separation means to aid in preventing reattachment of said mixing member to said sealing member once said sealing member is separated from said mixing member.

2. The apparatus of claim 1, wherein said separation means to aid in preventing reattachment of said mixing member to said sealing member comprises:

a) said mixing member having,
i) a top side,
ii) a bottom side, and
iii) a rod attachment opening, including releasable attachment means, said rod attachment opening serving to releasably receive said mixing rod;

b) said sealing member, said sealing member being releasably attached to said bottom side of said mixing member, said sealing member having a bearing surface which overlays said rod attachment opening of said mixing member, preventing passage of said materials through said rod attachment opening; and c) said mixing rod, said mixing rod being received by said rod attachment opening in said mixing member and entering at said top side of said mixing member, said mixing rod having,
i) a first end,
ii) a second end,
iii) a middle portion,
iv) a second end portion, and
v) a first end portion, said first end portion including releasable attachment means, said releasable attachment means being engaged with said releasable attachment means of said rod attachment opening, said first end portion being formed to be received by said rod attachment opening in said mixing member, and said first end portion being formed so that said first end portion of said mixing rod can be received by said rod attachment opening of said mixing member with said first end of said mixing rod bearing upon said bearing surface of said sealing member forcing said sealing member to separate and remain separated from said mixing member.

3. The apparatus of claim 2, further comprising:

a) said mixing member, having a stop; and b) said mixing rod which is received by said rod attachment opening in said mixing member, having a stop, said stop limiting entry of said first end portion into said rod attachment opening of said mixing member by bearing upon said stop of said mixing member, wherein said stops of said mixing rod and said mixing member are located at selected positions which allow said first end of said mixing rod to protrude past said bottom side of said mixing member a selected distance when said mixing rod is attached to said mixing member and said stops of said mixing rod and said mixing member meet, preventing further entry of said mixing rod into said rod attachment opening of said mixing member, such that said first end of said mixing rod bears upon said bearing surface of said sealing member and forces said sealing member to disengage from and remain separated from said mixing member.

4. The apparatus of claim 2, further comprising:

a) said mixing member, having a female attachment portion, said female attachment portion including,
i) a first shoulder, and
ii) a second cooperating shoulder; and b) said sealing member, having a male attachment portion, said male attachment portion including,
i) a first shoulder which bears upon said first shoulder of said mixing member when said mixing member and said sealing member are in registration and properly aligned, and
ii) a second cooperating shoulder which bears upon said second cooperating shoulder of said mixing member when said mixing member and said sealing member are in registration and properly aligned, wherein said first and second shoulders of said sealing member in conjunction with said first and second shoulders of said mixing member releasably hold said mixing member to said sealing member.

5. The apparatus of claim 4, further comprising:

said mixing member, having a circular outer ring, said circular outer ring protruding from said bottom side of said mixing member, said circular outer ring having,
a) an inner surface disposed away from said inner surface of said cylindrical container, and
b) an outer surface disposed toward said inner surface of said cylindrical container; and wherein said first and second shoulders of said mixing member are formed as lateral protrusions on said inner surface of said circular outer ring.

6. The apparatus of claim 5, wherein:

said first and second shoulders of said mixing member extend around said inner surface of said circular outer ring and join to form a single continuous protrusion on said inner surface of said circular outer ring.

7. The apparatus of claim 2, further comprising:

a) said mixing member, having a male attachment portion, said male attachment portion including,
1) a first shoulder, and
2) a second cooperating shoulder; and b) said sealing member, having a female attachment portion, said female attachment portion including,
1) a first shoulder which bears upon said first shoulder of said mixing member when said mixing member and said sealing member are in registration and properly aligned, and
2) a second cooperating shoulder which bears upon said second cooperating shoulder of said mixing member when said mixing member and said sealing member are in registration and properly aligned, wherein said first and second shoulders of said sealing member in conjunction with said first and second shoulders of said mixing member releasably hold said mixing member to said sealing member.

8. The apparatus of claim 2, wherein:

a) said releasable attachment means of said rod attachment opening of said mixing member consists of a thread formed in said rod attachment opening of said mixing member; and b) said releasable attachment means of said first end portion of said mixing rod consists of a thread formed in said first end portion of said mixing rod, said thread corresponding to said thread formed in said rod attachment opening of said mixing member.

9. The apparatus of claim 6, wherein: said thread of said first end portion of said mixing rod is positioned adjacent said first end of said mixing rod, so that said thread of said first end portion of said mixing rod engages said thread of said rod attachment opening of said mixing member before said first end of said mixing rod bears upon said bearing surface of said sealing member.

10. The apparatus of claim 2, further comprising:

said mixing member, having a circular outer ring.

11. The apparatus of claim 2, further comprising:

said mixing member, having a plurality of ribs, each of said ribs having a lateral edge, said lateral edge being disposed in close proximity to said inner surface of said cylindrical container when said mixing member is attached to said sealing member and placed in said cylindrical container such that said sealing member is disposed perpendicular to said inner surface of said cylindrical container, said ribs helping said sealing member to remain perpendicular to said inner surface of said cylindrical container.

12. The apparatus of claim 2, wherein:

said second end is formed as a regular polygon, and said second end portion of said mixing rod is an extension of said second end.

13. The apparatus of claim 2, further comprising:

said sealing member, having a vent.

14. The apparatus of claim 2, wherein said apparatus further comprises:

said sealing member, having a protrusion, said protrusion being in engagement with said mixing spoke when said mixing member and said sealing member are releasably attached, said protrusion preventing relative sliding rotation between said mixing member and said sealing member when said sealing member and said mixing member are releasably attached.

15. The apparatus of claim 14, wherein:

said protrusion on said sealing member extends around said sealing member except for an area corresponding to said mixing spoke, so that said sealing member can only attach to said mixing member when said mixing member and said sealing member are in a specific selected alignment.

16. The apparatus of claim 2, wherein said apparatus further comprises:

said sealing member, having a plurality of protrusions, said protrusions on said sealing member covering said sealing member except for an area corresponding to said mixing spoke, so that said sealing member can only attach to said mixing member when said mixing member and said sealing member are in a specific selected alignment.

17. The apparatus of claim 2, wherein said apparatus further comprises:

said mixing member, having a protrusion on said mixing spoke, said protrusion entering said opening in said sealing member when said sealing member and said mixing member are releasably attached, said protrusion on said mixing spoke preventing relative sliding rotation of said mixing member and said sealing member when said sealing member and said mixing member are releasably attached.

18. The apparatus of claim 2, wherein said mixing member has only one said mixing spoke, and said sealing member has only one said opening that is covered by said mixing spoke when said sealing member and said mixing member are releasably attached, said apparatus further comprising:

said mixing spoke, having a protrusion, said protrusion entering said opening when said sealing member and said mixing member are releasably attached.

19. The apparatus of claim 2, wherein said sealing member has a plurality of said openings, and said mixing member has a plurality of said mixing spokes that cover said plurality of said openings in said sealing member when said mixing member and said sealing member are releasably attached and properly aligned, said apparatus further comprising:

said mixing spokes, each having a protrusion that enters said openings in said mixing member when said mixing member and said sealing member are attached and properly aligned, said mixing spokes and said corresponding openings in said sealing member having a selected radial orientation with respect to each other such that said sealing member can only attach to said mixing member when said mixing member and said sealing member are in a specific selected alignment.

20. The apparatus of claim 2, wherein said sealing member has a plurality of said openings, and said mixing member has a plurality of said mixing spokes that cover said plurality of said openings in said sealing member when said mixing member and said sealing member are releasably attached and properly aligned, said apparatus further comprising:

selected mixing spokes having a protrusion that can enter only selected openings in said sealing member, such that said sealing member can only attach to said mixing member when said mixing member and said sealing member are in a specific selected alignment.

21. The apparatus of claim 20, further comprising:

a) said mixing member, having a stop; and b) said mixing rod which is received by said rod attachment opening in said mixing member, having a stop, said stop limiting entry of said first end portion into said rod-attachment opening of said mixing member by bearing upon said stop of said mixing member, wherein said stops of said mixing rod and said mixing member are located at selected positions which allow said first end of said mixing rod to protrude past said bottom side of said mixing member a selected distance when said mixing rod is attached to said mixing member and said stops of said mixing rod and said mixing member meet, preventing further entry of said mixing rod into said rod attachment opening of said mixing member, such that said first end of said mixing rod bears upon said bearing surface of said sealing member and forces said sealing member to disengage from and remain separated from said mixing member.

22. The apparatus of claim 21, further comprising:

a) said mixing member, having a female attachment portion, said female attachment portion including,
i) a first shoulder, and
ii) a second cooperating shoulder; and b) said sealing member, having a male attachment portion, said male attachment portion including,
i) a first shoulder which bears upon said first shoulder of said mixing member when said mixing member and said sealing member are in registration and properly aligned, and
ii) a second cooperating shoulder which bears upon said second cooperating shoulder of said mixing member when said mixing member and said sealing member are in registration and properly aligned, wherein said first and second shoulders of said sealing member in conjunction with said first and second shoulders of said mixing member releasably hold said mixing member to said sealing member.

23. The apparatus of claim 22, wherein:

a) said releasable attachment means of said rod attachment opening of said mixing member consists of a thread formed in said rod attachment opening of said mixing member; and b) said releasable attachment means of said first end portion of said mixing rod consists of a thread formed in said first end portion of said mixing rod, said thread corresponding to said thread formed in said rod attachment opening of said mixing member.

24. The apparatus of claim 23, wherein:

said thread of said first end portion of said mixing rod is positioned adjacent said first end of said mixing rod, so that said thread of said first end portion of said mixing rod engages said thread of said rod attachment opening of said mixing member before said first end of said mixing rod bears upon said bearing surface of said sealing member.

25. The apparatus of claim 24, further comprising:

said mixing member, having a circular outer ring.

26. The apparatus of claim 25, further comprising:

said circular outer ring, protruding from said bottom side of said mixing member, said circular outer ring having,
a) an inner surface disposed away from said inner surface of said cylindrical container, and
b) an outer surface disposed toward said inner surface of said cylindrical container; and wherein said first and second shoulders of said mixing member are formed as lateral protrusions on said inner surface of said circular outer ring.

27. The apparatus of claim 26, further comprising:

said mixing member, having a plurality of ribs, each of said ribs having a lateral edge, said lateral edge being disposed in close proximity to said inner surface of said cylindrical container when said mixing member is attached to said sealing member and placed in said cylindrical container such that said sealing member is disposed perpendicular to said inner surface of said cylindrical container, said ribs helping said sealing member to remain perpendicular to said inner surface of said cylindrical container.

28. The apparatus of claim 27, wherein:

said second end is formed as a regular polygon, and said second end portion of said mixing rod is an extension of said second end.

29. The apparatus of claim 28, further comprising:

said sealing member, having a vent.

30. The apparatus of claim 1, wherein said separation means to aid in preventing reattachment of said mixing member to said sealing member comprises:

said sealing member, having a protrusion, said protrusion on said sealing member extending around said sealing member except for an area corresponding to said mixing spoke, so that said sealing member can only attach to said mixing member when said mixing member and said sealing member are in a specific selected alignment.

31. The apparatus of claim 1, wherein said separation means to aid in preventing reattachment of said mixing member to said sealing member comprises:

said sealing member, having a plurality of protrusions, said protrusions on said sealing member covering said sealing member except for an area corresponding to said mixing spoke, so that said sealing member can only attach to said mixing member when said mixing member and said sealing member are in a specific selected alignment.

32. The apparatus of claim 1, wherein said mixing member has only one said mixing spoke, and said sealing member has only one said opening that is covered by said mixing spoke when said sealing member and said mixing member are releasably attached and wherein said separation means to aid in preventing reattachment of said mixing member to said sealing member comprises:

said mixing spoke, having a protrusion, said protrusion entering said opening when said sealing member and said mixing member are releasably attached.

33. The apparatus of claim 1, wherein said sealing member has a plurality of said openings, and said mixing member has a plurality of said mixing spokes that cover said plurality of said openings in said sealing member when said mixing member and said sealing member are releasably attached and properly aligned, and wherein said separation means to aid in preventing reattachment of said mixing member to said sealing member comprises:

said mixing spokes, each having a protrusion that enters said openings in said mixing member when said mixing member and said sealing member are attached and properly aligned, said mixing spokes and said corresponding openings in said sealing member having a selected radial orientation with respect to each other such that said sealing member can only attach to said mixing member when said mixing member and said sealing member are in a specific selected alignment.

34. The apparatus of claim 1, wherein said sealing member has a plurality of said openings, and said mixing member has a plurality of said mixing spokes that cover said plurality of said openings in said sealing member when said mixing member and said sealing member are releasably attached and properly aligned, and wherein said separation means to aid in preventing reattachment of said mixing member to said sealing member comprises:

selected mixing spokes having a protrusion that can enter only selected openings in said sealing member, such that said sealing member can only attach to said mixing member when said mixing member and said sealing member are in a specific selected alignment.

35. The apparatus of claim 1, wherein said separation means to aid in preventing reattachment of said mixing member to said sealing member comprises:

a) said mixing member having, i) a top side, ii) a bottom side, and iii) a rod attachment opening, including attachment means, said rod attachment opening serving to receive said mixing rod;

b) said sealing member, said sealing member being releasably attached to said bottom side of said mixing member, said sealing member having a bearing surface which overlays said rod attachment opening of said mixing member, preventing passage of said materials through said rod attachment opening; and c) said mixing rod, said mixing rod being received by said rod attachment opening in said mixing member and entering at said top side of said mixing member, said mixing rod having, i) a first end, ii) a second end, iii) a middle portion, iv) a second end portion, and v) a first end portion, said first end portion including attachment means engaged with said attachment means of said rod attachment opening, said first end portion being formed to be received by said rod attachment opening in said mixing member, and said first end portion being formed so that said first end portion of said mixing rod can be received by said rod attachment opening of said mixing member with said first end of said mixing rod bearing upon said bearing surface of said sealing member forcing said sealing member to separate and remain separated from said mixing member.

* * * * *

UNITED STATES PATENT AND TRADEMARK OFFICE

CERTIFICATE OF CORRECTION

PATENT NO. : 5,829,875
DATED : November 3, 1998
INVENTOR(S) : Gerald W. Hagel et al.

It is certified that error appears in the above-identified patent and that said Letters Patent is hereby corrected as shown below:

Column 17,
Line 29, replace "The apparatus of claim 6" with -- The apparatus of claim 8 --.

Signed and Sealed this

Fourteenth Day of May, 2002

*Attest:*

*Attesting Officer*

JAMES E. ROGAN
*Director of the United States Patent and Trademark Office*